United States Patent [19]

Suzuki

[11] 4,045,857

[45] Sept. 6, 1977

[54] METHOD FOR MANUFACTURE OF ALUMINUM SHEET AND SINTERED HIGH-DENSITY ALUMINUM LAMINATE BY DIRECT POWDER ROLLING PROCESS

[75] Inventor: Yoshikazu Suzuki, Sapporo, Japan

[73] Assignee: Agency of Industrial Science & Technology, Tokyo, Japan

[21] Appl. No.: 521,369

[22] Filed: Nov. 6, 1974

[30] Foreign Application Priority Data

Nov. 8, 1973 Japan ..... 48-125184

[51] Int. Cl.[2] ..... B22F 3/24

[52] U.S. Cl. ..... 29/420; 29/DIG. 31; 29/DIG. 32; 29/419 R; 75/208 CS; 75/226; 428/554

[58] Field of Search ..... 29/DIG. 31, DIG. 32, 29/419 R, 420, 420.5, 182.2, 182.3; 75/208 R, 226, 208 CS, 214

[56] References Cited

U.S. PATENT DOCUMENTS

| | | | |
|---|---|---|---|
| 2,155,651 | 4/1939 | Goetzel | 29/420.5 UX |
| 2,287,251 | 6/1942 | Jones | 29/DIG. 31 |
| 2,383,766 | 8/1945 | Brassert | 29/420.5 X |
| 2,391,752 | 12/1945 | Stern | 29/420.5 X |
| 2,932,883 | 4/1960 | Weber | 29/420.5 |
| 2,967,351 | 1/1961 | Roberts et al. | 29/420.5 |
| 3,084,421 | 4/1963 | McDanels et al. | 29/420.5 X |
| 3,142,560 | 7/1964 | Storchheim | 29/420.5 |
| 3,331,684 | 7/1967 | Storchheim | 75/214 |
| 3,389,993 | 6/1968 | Lund et al. | 29/420.5 X |
| 3,432,295 | 3/1969 | Frank et al. | 29/420.5 X |
| 3,609,855 | 10/1971 | Schmidt | 29/419 UX |
| 3,664,889 | 5/1972 | McCarthy et al. | 29/420.5 |
| 3,687,657 | 8/1972 | Strochheim | 75/214 |

FOREIGN PATENT DOCUMENTS

| | | | |
|---|---|---|---|
| 1,341,544 | 12/1973 | United Kingdom | 29/420 |

*Primary Examiner*—C.W. Lanham
*Assistant Examiner*—V. Rising
*Attorney, Agent, or Firm*—Oblon, Fisher, Spivak, McClelland & Maier

[57] ABSTRACT

An aluminum sheet having a prescribed thickness is obtained by compacting aluminum powder into a green sheet of packed aluminum powder, sintering the green sheet at temperatures of 300° C to 600° C and subsequently rolling and annealing the sintered sheet of aluminum powder at least once. A high-density sintered aluminum laminate is produced by piling a plurality of green sheets of packed aluminum powder one on top of another, sintering the pile of green sheets and then rolling and heating the sintered pile of sheets at least once.

5 Claims, 4 Drawing Figures

METHOD FOR MANUFACTURE OF ALUMINUM SHEET AND SINTERED HIGH-DENSITY ALUMINUM LAMINATE BY DIRECT POWDER ROLLING PROCESS

BACKGROUND OF THE INVENTION

This invention relates to a method for the manufacture of an aluminum sheet of a prescribed thickness by the steps of compacting aluminum powder and treating the resultant green sheet of packed aluminum powder and further to a method for the manufacture of high-density sintered aluminum laminate by the steps of piling a plurality of green sheets of packed aluminum powder and treating the resultant pile of sheets.

SAP (Sintered Aluminum Powder) has been suggested as a method for the manufacture of sintered aluminum metal from aluminum powder. This method comprises converting fine aluminum particles produced from aluminum stock into aluminum powder containing alumina either by adjusting the oxide coat formed on the surface layer of said fine aluminum particles or by incorporating alumina from an external source, compression molding the alumina-containing aluminum powder, sintering the resulting mold by application of heat and then extrusion molding the sintered mold. However, it is extremely difficult to effect the manufacture of sintered aluminum metal continuously by this method.

Further, the aluminum powder generally has a stable oxide coat formed on the surface of its individual particles. For this reason, it is extremely difficult for a packed piece of aluminum powder to be sintered by application of heat at a temperature below the melting point of the packed aluminum powder.

There is also known a powder rolling process available for the production of sheets from powdered metal. This manufacturing process has been studied from various angles. To be commercially feasible, this process is required to be such that it can be carried out under continuous operation. Fundamentally, any process involved in the manufacture of a sheet from powdered metal generally comprises the steps of producing a green sheet of powdered metal, sintering the green sheet in a heating furnace and finally rolling the sintered sheet. In the case of aluminum powder, for the operation to be accomplished continuously, it is essential that the sintering of the sheet within the heating furnace be effected while the sheet is in motion at a fixed rate. Since the sheet is required to be retained within the furnace until sintering has been thoroughly effected thereon, the advantage of this process increases in proportion as the time required for the sintering is shortened. In order for the oxide coat formed on the fine aluminum particles to be melted, heating is required to be given at a temperature above at least 800° C. To preclude the phenomenon of oxidation during the heating, the sintering must be carried out in an atmosphere without oxygen, namely, in the atmosphere of an inert gas such as argon, nitrogen or helium or of a reducing gas such as hydrogen. For successful continuous production of aluminum sheets on a commercial scale, this process has many technically difficult problems yet to be solved.

An object of this invention is to provide a method for continuously manufacturing, on a commercial scale, aluminum sheets excelling in mechanical strength and having a prescribed thickness from aluminum powder.

Another object of this invention is to provide a method for the manufacture of a high-density sintered aluminum laminate excelling in mechanical strength from aluminum powder.

SUMMARY OF THE INVENTION

To attain the objects described above according to the present invention, there are provided two methods: The one method comprises compacting aluminum powder into a green sheet of packed aluminum powder, heating the green sheet at temperatures of from 300° C to 600° C for thereby sintering the packed aluminum powder in the sheet and quickly subjecting the sintered sheet to the treatment of rolling and annealing at least once to obtain an aluminum sheet of a prescribed thickness. The other method comprises piling a plurality of green sheets of packed aluminum powder prepared as described above one on top of another, heating the pile of slabs at temperatures of from 300° C to 600° C for thereby sintering the packed aluminum powder in the sheets and at the same time fusing adjoining faces of the aluminum sheets and quickly subjecting the unitized pile to the treatment of rolling and heating at least once to obtain a high-density sintered aluminum laminate having a prescribed thickness. The present invention also embraces a method whereby a reinforcing material is interposed between each pair of adjoining faces of the plurality of green sheets being piled one on top of another and thereafter subjecting the pile to the procedure of the latter of the two methods described above to obtain a high-density sintered aluminum laminate having an increased strength and a prescribed thickness.

Other characteristics and advantages of the present invention will become apparent from the following description.

DETAILED DESCRIPTION OF THE INVENTION

Figure 1:
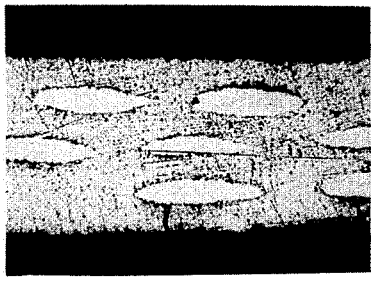
FIG. 1 is a photomicrographic cross-sectional view of a high-density sintered aluminum laminate using copper sheets as the reinforcing material.

Spray aluminum available on the market or aluminum powder produced by some other suitable method can be used as the raw material for the aluminum porducts of the present invention.

A typical aluminum powder desirably used for this invention has the following chemical composition and particle size distribution:

Composition — 99.8% by weight of aluminum and 0.15% by weight of $O_2$ (equivalent to 0.32% by weight of $Al_2O_3$)

Particle size distribution — 0.6% of particles exceeding 200μ, 1.3% of particles between 160μ and 200μ, 2.6% of particles between 120μ and 160μ, 9.9% of particles between 80μ and 120μ, 35.6% of particles between 40μ and 80μ and 5% of particles smaller than 40μ

First, a description will be given of the preparation of an aluminum sheet from the aluminum powder.

A green sheet having a fixed strength and uniform density distribution in the direction of width is produced by the known direct rolling method from said aluminum powder. This production can be accomplished as by causing the aluminum powder placed in a hopper to fall into a pair of rolls separated uniformly by a fixed.

In the sheet produced by the rolling of the pair of rolls, the density is uniformly distributed in the direction of width.

As a result of the pressure from the rolling, the oxide coat formed on the surface layer of individual aluminum particles within the greet sheet is fractured to expose the underlying metallic aluminum, and adjoining aluminum particles throughout the entire sheet interior are pressed against one another into cohesion, giving the sheet a fixed magnitude of strength. Then, the green sheet is sintered by being heated at temperatures in the range of from 300° C to 600° C. If the heating is given at temperatures below the lower limit 300° C, desired sintering is not effected. Aluminum has a melting point of about 660° C. When the heating is carried out in the range of from 300° C to 600° C, therefore, possible oxidation of aluminum powder in the atmosphere proceeds at an extremely low rate so that the sheet can be sintered to a suitable degree of strength without being appreciably affected by oxidation. Naturally, this heating for sintering may be given in the atmosphere of an inert gas instead of air. The time required for the sintering is three to ten minutes so far as the heating is given at temperatures falling within the aforementioned range.

For practical purposes, the whole operation which comprises the preparation of green sheet by rolling, the sintering of the green sheet by heating and the rolling of the sintered sheet can be continuously performed by disposing a heating furnace (having a length of 10 to 15m, for example) immediately after the rolling unit serving to introduce the aluminum powder through a hopper into a pair of rolls, installing a rolling system designed to handle the sintered sheet immediately after the heating furnace and suitably controlling and coordinating the rates at which the component units are operated.

Annealing is given subsequent to the last rolling treatment for the purpose of increasing the mechanical strength of the finally produced aluminum sheet. Installation of a furnace posteriorly to the rolling system will suffice for the annealing. By repeating the rolling and annealing treatment, the mechanical strength of the aluminum sheet is increased and the thickness thereof can easily be decreased to the prescribed value. Thus, the method of the present invention permits the production on a commercial scale of aluminum sheets to be effected in a continuous operation.

For the rolling treatment which follows the sintering treatment, the draft is suitably in the range of from 25 to 50%. This is because the green sheet obtained by the direct powder rolling technique, when exposed to the strain of the final rolling which exceeds the binding strength acquired in the course of sintering, tends to sustain cracks which have an undesirable effect on the final product.

According to the method of this invention, the green sheet of packed aluminum powder is sintered in the atmosphere of air or an inert gas to a fixed magnitude of strength without suffering the otherwise possible effect of oxidation and immediately thereafter is subjected to the treatment of rolling and annealing either repeatedly or otherwise, making it possible to produce high-density aluminum sheets from the aluminum powder continuously. Compared with aluminum sheets which are produced by the smelting method, the aluminum sheets produced by the present invention provide more desirable strength and elongation in proportion to the decrease in porosity and enjoy greater mechanical strength because oxide coat is uniformly distributed throughout the entire product interior.

The method of this invention for the manufacture of a high-density sintered aluminum will now be described. This method and the method for the manufacture of an aluminum sheet described above coincide up to the preparation of green sheet of packed aluminum powder.

Then, a plurality of green sheets are piled one on top of another. The number of green sheets thus piled up is determined in accordance with the thickness and strength to be required of the article in which the final product laminate is used. Then, the pile of green sheets of aluminum is sintered by being heated at temperatures in the range of from 300° C to 600° C in the atmosphere and, before it is allowed to cool to below 300° C, it is rolled as by means of rolls. Because of the treatment of heating and rolling, the aluminum particles in each green sheet of aluminum powder behave in entirely the same manner as those in the green sheet used in the manufacture of aluminum sheet. In addition, the oxide film formed on the surface of each green sheet is fractured to expose the underlying aluminum metal so that the adjoining green sheets are allowed to adhere fast to each other through the intimate union of newly exposed aluminum particles. Further, the rolling promotes compaction of aluminum particles and consequently increases the density of each green sheet. Thus, the final product according to this method is a sintered aluminum laminate enjoying high density. Where the aluminum laminate is required to provide an increased strength, the requirement is fulfilled by interposing a reinforcing material between each pair of adjoining green sheets and subjecting the resultant pile to the rest of the procedure of the method described above. Particularly suitable reinforcing materials are metallic wires, fibrous inorganic materials, whiskers, etc. The kind and the quantity of reinforcing material to be used may suitably selected in due consideration of the purpose of reinforcement. It is not always necessary that such reinforcing material be used to intervene between all the adjoining green sheets. Nor is it invariably necessary to spread the reinforcing material throughout the entire adjoining surfaces. This is a matter of choice depending on the object of reinforcement. Copper wire, piano wire, tungsten wire, etc. are typical metallic wires, quartz fibers, carbon fibers, boron nitride fibers, etc. are examples of fibrous inorganic materials and $\alpha$—$Al_2O_3$ whiskers, SiC whiskers, etc. are usable as whiskers.

When a reinforcing material is incorporated as described above, the produced high-density sintered aluminum laminate acquires an added strength. The reinforcing materials enumerated above do not undergo any chemical reaction with aluminum within the range of temperatures used for the method of this invention, indicating that the use of these reinforcing materials will not lead to embrittlement of the product. The aluminum sheet produced from aluminum powder according to the present invention enjoys the characteristics described above and, therefore, is suitable for use in chemical devices and building materials in particular. The high-density aluminum laminate manufactured by this invention finds extensive utility in electrical appliances as a substitute for copper and in spacecraft, aircraft and other vehicles of conveyance as well.

The effect of this invention will be described with reference to preferred embodiments herein below. It should be understood that the present invention is not limited to these examples.

EXAMPLE 1

A spray aluminum powder (chemical composition — 99.8% by weight of Al and 0.15% by weight of $O_2$ (equivalent of 0.32% by weight of $Al_2O_3$; particle size distribution — 14.4% of particles exceeding 80μ, 35.6% of particles between 40μ and 80μ and 50.0% of particles smaller than 40μ) was introduced through a hopper into a roll mill, in which it was continuously rolled into a green sheet. Then the green sheet was sintered. The sintered sheet was further sintered and then subjected to the treatment of rolling and annealing repeatedly to produce an aluminum sheet of a prescribed thickness. The conditions under which the green sheet was produced from the aluminum powder are shown in Table 1 and 3, and the conditions under which the aluminum sheet was obtained from the green sheet are shown in Tables 2 and 4. For the specimens 5 and 6 indicated in Table 4, the sintering was carried out at 550° C. To preclude possible coarsening of recrystallized particles, the final annealing was carried out at 500° C.

Table 1

Conditions for production of green sheet from aluminum powder

| Roll aperture | Hopper width | Hopper aperture | Rotation rate of roll | Rolling speed | Thickness of green sheet |
|---|---|---|---|---|---|
| 0.7mm | 100mm | 25–35mm | 5 rpm | 3.14m/min | 0.88–0.89mm |

Table 2

| Specimen No. | Sintering temperature | Sintering time | Gas used in atmosphere | First draft | Annealing temperature | Time | Second draft | Annealing temperature | Time | Third draft | Annealing temperature | Time | Thickness of speciment |
|---|---|---|---|---|---|---|---|---|---|---|---|---|---|
| 1 | 400° C | 5 min | air | 29.2% | 400° C | 5 min | 26.6% | 400° C | 5 min | 30.7% | | | 0.31–0.32mm |
| 2 | " | " | " | " | " | " | " | " | " | " | 400° C | 5 min | " |
| 3 | 550° C | " | " | 44.5% | 550° C | " | 39.2% | | | | | | 0.30–0.31mm |
| 4 | " | " | " | " | " | " | " | 500° C | 5 min | | | | " |

Table 3

Conditions for production of green sheet from aluminum powder

| Roll aperture | Hopper width | Hopper aperture | Rotation rate of roll | Rolling speed | Thickness of green sheet |
|---|---|---|---|---|---|
| 0.7mm | 100mm | 1.9–2.0mm | 5 rpm | 3.14m/min | 0.50–0.60mm |

Table 4

| Specimen No. | Sintering temperature | Sintering time | Gas used in atmosphere | First draft | Annealing temperature | Time | Second draft | Annealing temperature | Time | Thickness of specimen |
|---|---|---|---|---|---|---|---|---|---|---|
| 5 | 400° C | 5 min | air | 40.0% | 400° C | 5 min | 31.8% | 400° C | 5 min | 0.20–0.21mm |
| 6 | 550° C | " | " | 41.8% | 550° C | " | 43.8% | 500° C | " | " |

Table 5 shows the results of the tensile test conducted on the aluminum sheets indicated in Tables 1 through 4.

Table 5

| Specimen No. | Density (g/cm³) Green sheet | Density (g/cm³) Final sheet | Tensile strength (kg/cm²) | Elongation (%) |
|---|---|---|---|---|
| 1 | 2.66 | 2.69 | 13.7 | 4.17 |
| 2 | " | " | 8.55 | 20.8 |
| 3 | " | " | 13.3 | 2.08 |
| 4 | " | " | 8.19 | 29.2 |
| 5 | 2.39 | 2.60 | 8.23 | 2.1 |
| 6 | " | 2.69 | 7.09 | 7.5 |

Generally, aluminum sheets 0.20 to 0.32mm in thickness obtained by the smelting method have tensile strength in the range of 8 to 12 kg/mm² and elongation in the range of 12 to 30%.

It is, therefore, clear from the comparison that the aluminum sheets according to the present invention are in no way inferior in mechanical properties to aluminum sheets produced by the smelting method.

EXAMPLE 2

After the procedure of Example 1, green sheets each measuring 0.46mm in thickness, several thousand mm in length and 50mm in width were produced from the same aluminum powder as used in Example 1 with an apparatus comprising a hopper and rolls which are both known to the art under the conditions given below.

| | |
|---|---|
| Roll aperture | 0.7mm |
| Hopper width | 50mm |
| Hopper aperture | 1.25mm |
| Rotating rate of rolls | 4 rpm |
| Rolling rate | 2.51 m/min |

These green sheets were cut to a length of 1000mm and piled in groups of three or four sheets as indicated in the following table. The piles were each subjected to the treatment of rolling and heating repeatedly. The conditions of the treatment and the results were as shown in Tables 6 and 7. In the treatment of rolling, the piles were heated at 500° C for 5 minutes in the atmosphere. After the final rolling, the piles were subjected to annealing under the same conditions of heating.

In Test Specimens 1 and 2, copper wires 0.15mm in diameter were arranged at intervals of 0.3mm between all the adjoining green sheets. In Test Specimen 3, quartz fibers 1 to 5μ in diameter were spread to a small uniform thickness between all the adjoining green sheets. In Test Specimen 4, no reinforcing material was used.

Table 6

| Test specimen No. | Number of green sheets used | Reinforcing material | Thickness of pile (mm) | Heating conditions: Temperature (° C) | Heating conditions: (min) | Laminate thickness after rolling treatment (mm) (Parenthesized are drafts) (%): 1st | 2nd | 3rd | 4th | 5th | 6th | 7th | 8th | 9th |
|---|---|---|---|---|---|---|---|---|---|---|---|---|---|---|
| 1 | 3 | copper wires | 1.37 | 500 | 5 | 1.20 (12.4) | 1.05 (12.5) | 0.77 (26.7) | 0.59 (23.4) | 0.39 (33.9) | 0.33 (15.4) | 0.24 (27.3) | | |
| 2 | 4 | " | 3.77 | " | " | 1.90 (49.6) | 1.63 (14.2) | 1.40 (14.1) | 1.18 (15.7) | 0.94 (20.3) | 0.73 (22.3) | 0.55 (24.7) | 0.43 (23.6) | 0.32 (25.6) |
| 3 | 4 | quartz fibers | 2.09 | " | " | 1.66 (20.6) | 1.35 (18.7) | 1.07 (20.7) | 0.88 (17.8) | 0.61 (30.7) | 0.41 (32.8) | 0.34 (17.1) | | |
| 4 | 3 | None | 1.37 | " | " | 1.09 (20.4) | 0.85 (22.0) | 0.63 (25.9) | 0.48 (23.8) | 0.33 (31.3) | | | | |

Table 7

| Test specimen | Density ($g/cm^3$) | Volume ratio of reinforcing material (vol%) | Tensile strength ($kg/mm^2$) | Breaking strength ($kg/mm^2$) | Elongation (%) | Electric resistivity ($\Omega$ . can) |
|---|---|---|---|---|---|---|
| 1 | 2.79 | 1.5 cu | 8.14 | 12.9 | 14.6 | $4.41 \times 10^{-6}$ |
| 2 | 3.47 | 12.3 cu | 9.29 | 10.9 | 10.2 | $4.24 \times 10^{-6}$ |
| 3 | 2.68 | 47 $SiO_2$ | 8.15 | 11.3 | 18.8 | $3.53 \times 10^{-6}$ |
| 4 | 2.70 | — | 8.03 | 18.7 | 27.5 | $3.31 \times 10^{-6}$ |

Table 7 shows the numerical values of physical properties found for the high-density sintered aluminum laminates produced under the conditions of Table 6.

In consideration of the fact that aluminum sheets 0.20 to 0.32mm in thickness obtained by the smelting method generally have tensile strength in the range of 8 to 12 $kg/mm^2$ and elongation in the range of 12 to 30%, it is clearly seen that the products obtained as described above by the method of this invention enjoy practically equal physical properties to those of the products obtained by the smelting method.

Test Specimen 1 was identical to Test Specimen 4 plus copper wires used as a reinforcing material. Table 7 shows that the former test specimen had an added mechanical strength, indicating that the use of the reinforcing manifested a conspicuous effect.

Figure 2:
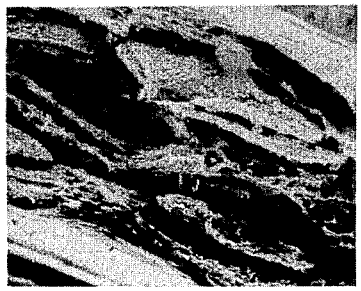
FIG. 2 is a photomicrographic cross-sectional view of the same laminate after tensile test.
Figure 3:
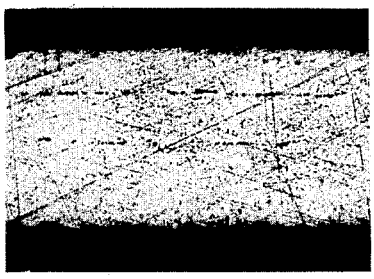
FIG. 3 is a photomicrographic cross-sectional view of a high-density sintered alumina laminate using quartz fibers as the reinforcing material.
Figure 4:
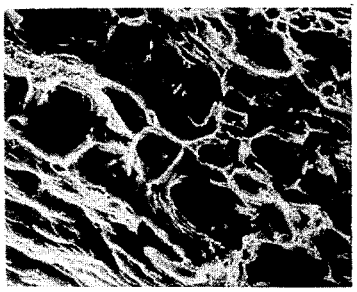
FIG. 4 is a photomicrographic cross-sectional view of the same laminate after tensile test.

The reinforcing material incorporated between the adjoining layers of the laminate was combined integrally with the aluminum metal so that the produced laminate displayed outstanding properties as a composite material. Photomicrographs of the textures of such laminates are shown in FIG. 1 through FIG. 4. FIG. 1 and FIG. 3 represent the cross sections of the test specimens 1 and 3 respectively, showing copper wires and quarts fibers uniformly distributed as the reinforcing material in the matrices of aluminum metal. FIG. 2 and FIG. 4 represent the cross sections of the laminates of FIG. 1 and FIG. 3 after they had undergone a tensile test, clearly showing the reinforcing materials were effective in enhancing the physical properties of the laminates. In FIG. 1 (100 magnifications), each white slender flat portion represents a copper wire and in FIG. 3 (100 magnifications), numerous longitudinal and lateral slender lines represent quartz fibers. The photomicrographs show that the respective reinforcing materials are uniformly distributed in the aluminum matrices. In FIG. 2 (170 magnifications) and in FIG. 4 (570 magnifications), the reinforcing materials are seen to have been deformed in conjunction with their respective matrices, suggesting that they play an important role in the reinforcement of the laminates.

I claim:

1. A method for the manufacture of a high density sintered aluminum laminate from aluminum powder which comprises directly rolling of aluminum in powder for the fracturing of the oxide coat on the surface layer of individual aluminum particles and for compacting the aluminum powder into green sheets under rolling pressure sufficient to cause coherence of the aluminum particles and so that the sheets have a fixed strength and uniform density in the direction of the width, piling a plurality of green sheets one on top of another with filaments of inorganic material interposed between adjoining pairs thereof as a reinforcing material, heating and simultaneously rolling the pile of green sheets at a draft in the range of from 25% to 50% at temperatures in the range of from 300° C to 600° C for a period of from 3 minutes to 10 minutes thereby forming a sintered aluminum laminate and then subjecting the sintered aluminum laminate at least once, before the laminate is allowed to cool below 300° C, to the treatment of rolling at a draft in the range of from 25% to 50% and to the subsequent treatment of annealing thereby allowing the laminate to acquire high density and prescribed thickness.

2. The method according to claim 1, wherein filaments of quarts are used as the filaments of inorganic material.

3. The method according to claim 1, wherein spray aluminum is used as the aluminum powder.

4. The method according to claim 1, wherein copper wires are used as the filaments of inorganic material.

5. The method according to claim 1, where whiskers are used as the filaments of inorganic material.

* * * * *